US009358692B2

(12) United States Patent
Schekalla

(10) Patent No.: US 9,358,692 B2
(45) Date of Patent: Jun. 7, 2016

(54) SAFETY KNIFE

(75) Inventor: Peter Schekalla, Wuppertal (DE)

(73) Assignee: Martor KG, Solingen (DE)

( * ) Notice: Subject to any disclaimer, the term of this patent is extended or adjusted under 35 U.S.C. 154(b) by 665 days.

(21) Appl. No.: 13/439,394

(22) Filed: Apr. 4, 2012

(65) Prior Publication Data

US 2013/0091712 A1 Apr. 18, 2013

(30) Foreign Application Priority Data

Apr. 12, 2011 (DE) ..... 10 2011 007 234

(51) Int. Cl.
*B26B 5/00* (2006.01)
*B26B 1/08* (2006.01)

(52) U.S. Cl.
CPC .. *B26B 5/003* (2013.01); *B26B 1/08* (2013.01)

(58) Field of Classification Search
CPC ..... B26B 1/08; B26B 5/003
USPC ..... 30/162
See application file for complete search history.

(56) References Cited

U.S. PATENT DOCUMENTS

| | | | | |
|---|---|---|---|---|
| 3,176,395 | A | 4/1965 | Warner et al. | |
| 4,805,304 | A | 2/1989 | Knoop | |
| 6,044,562 | A * | 4/2000 | Dillenbeck | 30/162 |
| 6,148,520 | A | 11/2000 | Berns | |
| 6,324,763 | B1 * | 12/2001 | Lee | B26B 5/001 30/125 |
| 6,775,911 | B2 * | 8/2004 | Tremblay | 30/162 |
| 7,765,701 | B2 | 8/2010 | Okada | |
| 8,353,109 | B2 * | 1/2013 | Rohrbach | 30/162 |
| 8,707,566 | B2 * | 4/2014 | Rohrbach | 30/162 |
| 8,769,826 | B2 * | 7/2014 | Wu | 30/162 |
| 2003/0019109 | A1 * | 1/2003 | Tremblay | 30/162 |
| 2007/0277382 | A1 * | 12/2007 | Okada | B26B 5/003 30/162 |
| 2008/0163493 | A1 * | 7/2008 | Votolato | 30/154 |
| 2009/0106983 | A1 * | 4/2009 | Berns | 30/162 |
| 2009/0260235 | A1 * | 10/2009 | Rohrbach | 30/162 |
| 2010/0319200 | A1 * | 12/2010 | Davis et al. | 30/162 |
| 2011/0035947 | A1 * | 2/2011 | Rohrbach | 30/162 |
| 2011/0302787 | A1 * | 12/2011 | Rohrbach | 30/162 |
| 2013/0091712 | A1 * | 4/2013 | Schekalla | 30/162 |
| 2014/0013605 | A1 * | 1/2014 | Wu | 30/162 |

FOREIGN PATENT DOCUMENTS

| | | | |
|---|---|---|---|
| CA | 2590535 | A1 | 12/2007 |
| DE | 3622342 | A1 | 1/1988 |

(Continued)

OTHER PUBLICATIONS

EP1985417 english translation; Peyrot, Jean Claude, Oct. 29, 2008.*

(Continued)

*Primary Examiner* — Laura M Lee
(74) *Attorney, Agent, or Firm* — Wood, Herron & Evans, LLP

(57) ABSTRACT

A knife (1) and a knife housing (2, 4). The knife comprises the housing (2, 4), which includes a blade slider (20) which is mounted to the housing (2, 4) and is reciprocable by means of an actuating device (6) between a safety position and a cutting position, and a return element (30) for applying a return force to the blade slider (20) in the direction of the safety position. The knife further comprises a blade (10) arranged on the blade slider (20). In this arrangement the blade (10) is mounted rotatably to the blade slider (20).

15 Claims, 17 Drawing Sheets

(56) References Cited

FOREIGN PATENT DOCUMENTS

| | | | |
|---|---|---|---|
| DE | 4315495 | A1 | 11/1994 |
| DE | 19601015 | A1 | 7/1997 |
| DE | 19723279 | C1 | 4/1998 |
| DE | 102007052060 | A1 | 5/2009 |
| EP | 1864766 | A1 | 12/2007 |
| EP | 2314430 | A1 | 4/2011 |

OTHER PUBLICATIONS

State Intellectual Property Office of People's Republic of China, Office Action dated Sep. 2, 2014 issued in Chinese application 201210107372.5.

* cited by examiner

Fig. 2a
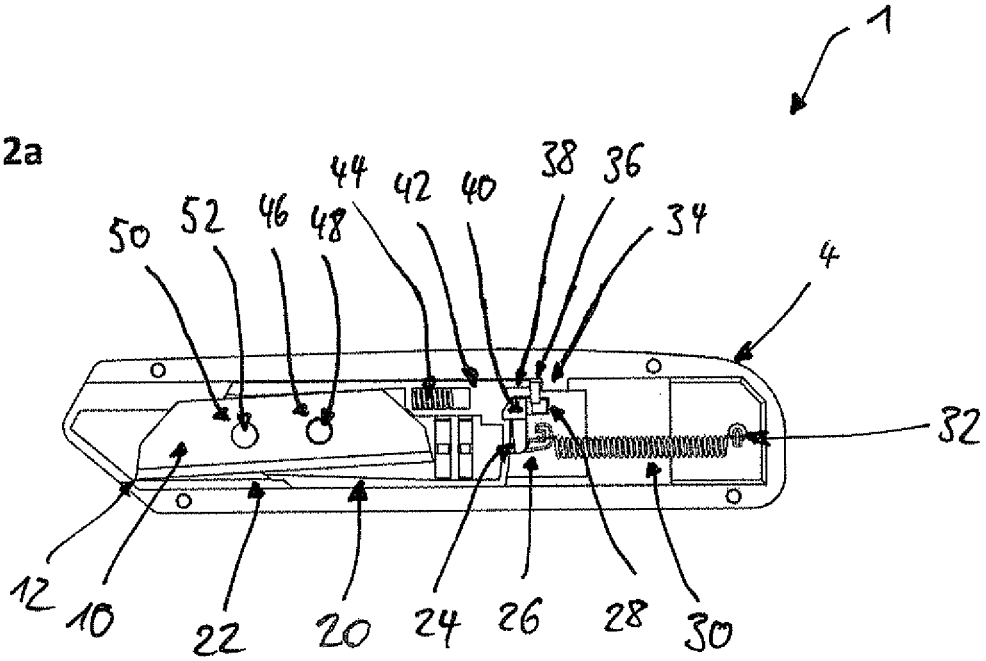
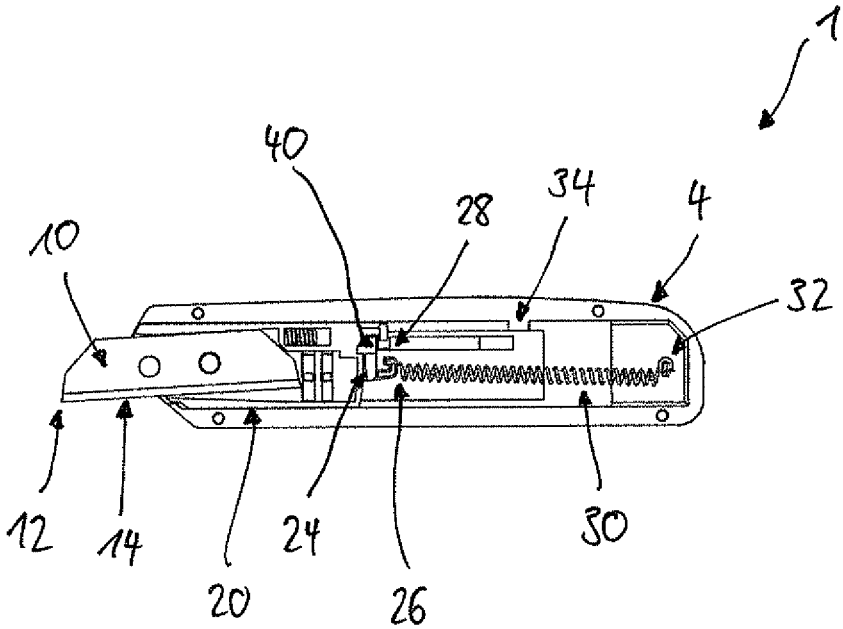
Fig. 2b

Fig. 2c
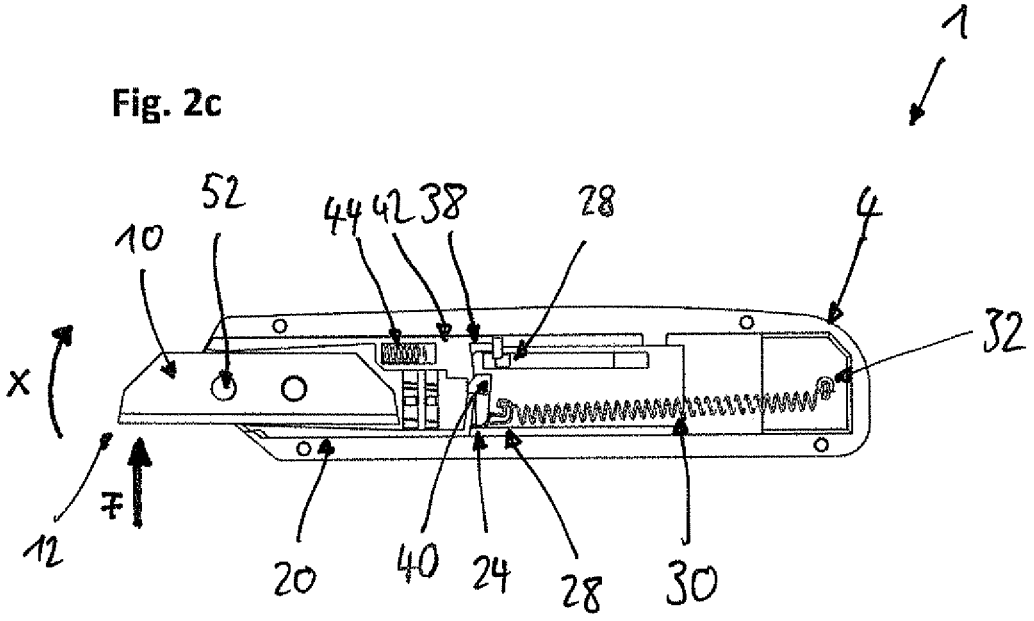
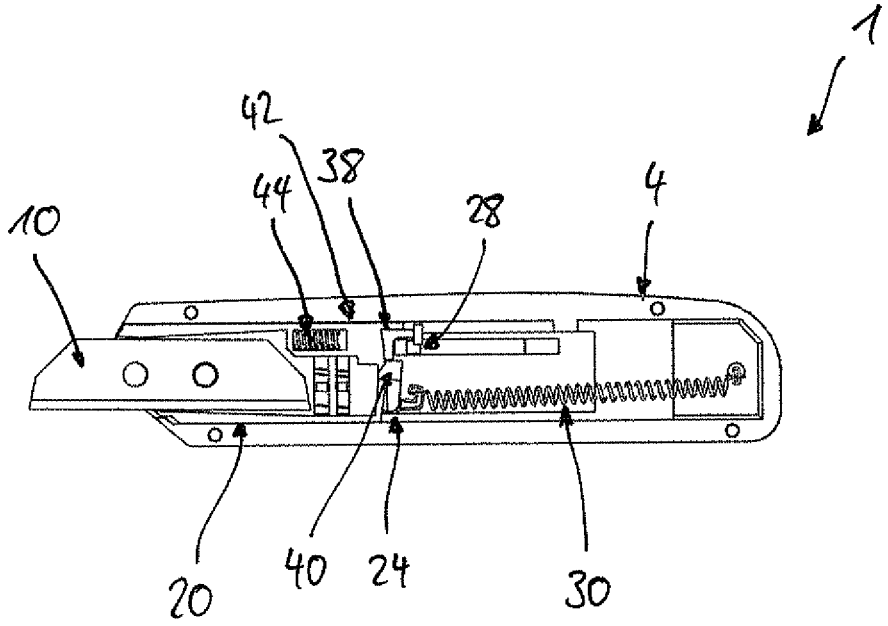
Fig. 2d

Fig. 2e
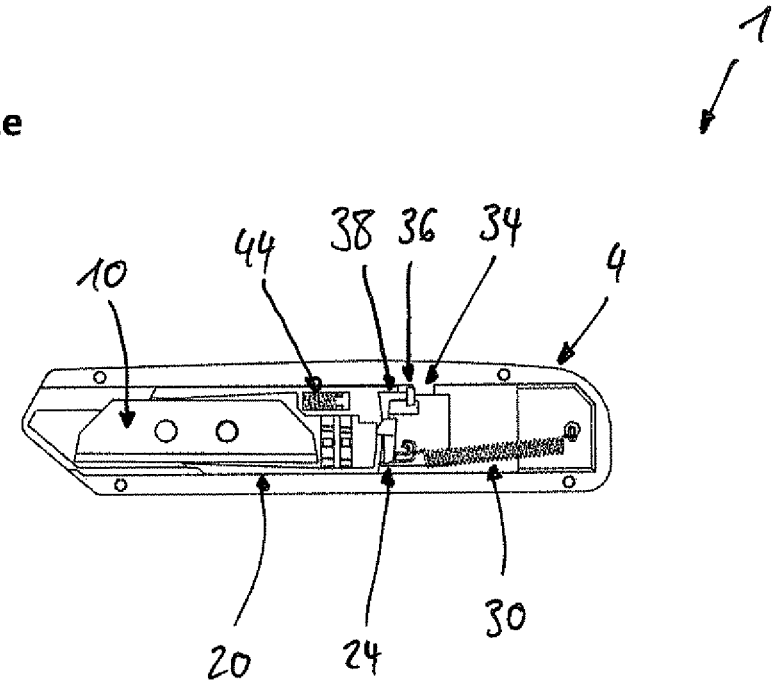
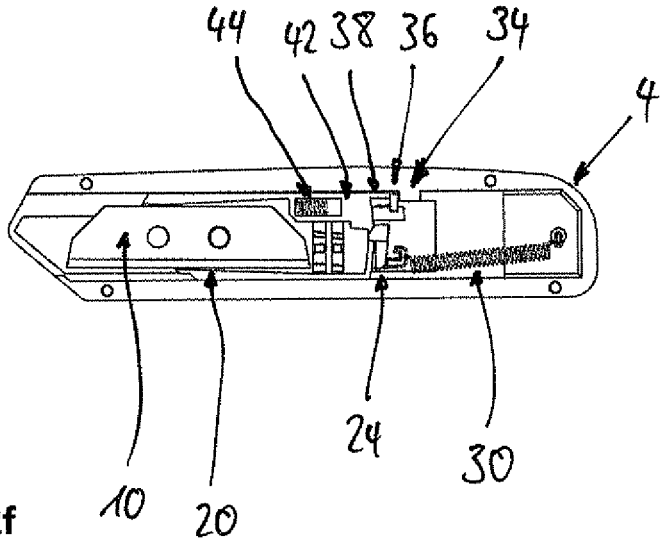
Fig. 2f

Fig. 3a
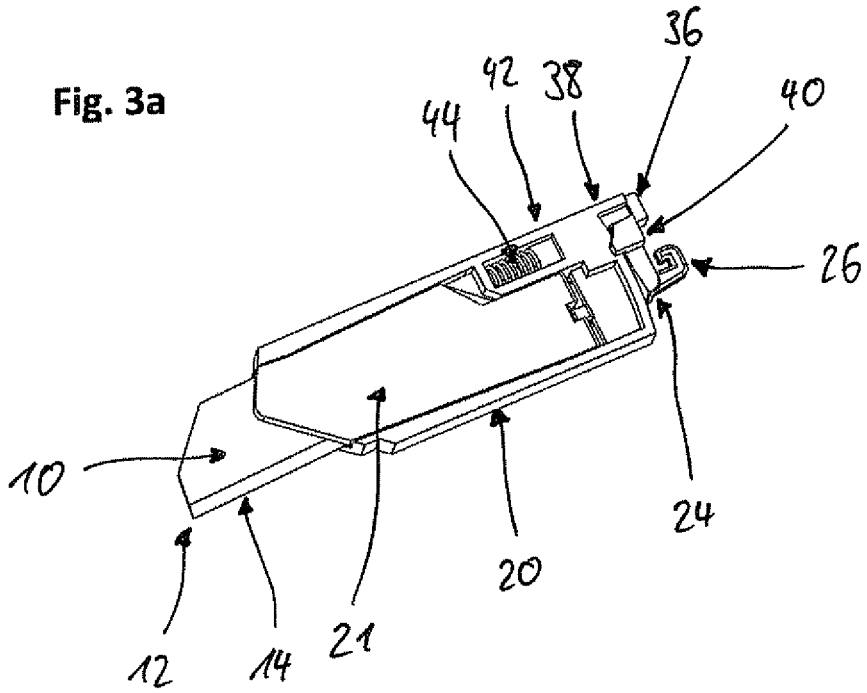
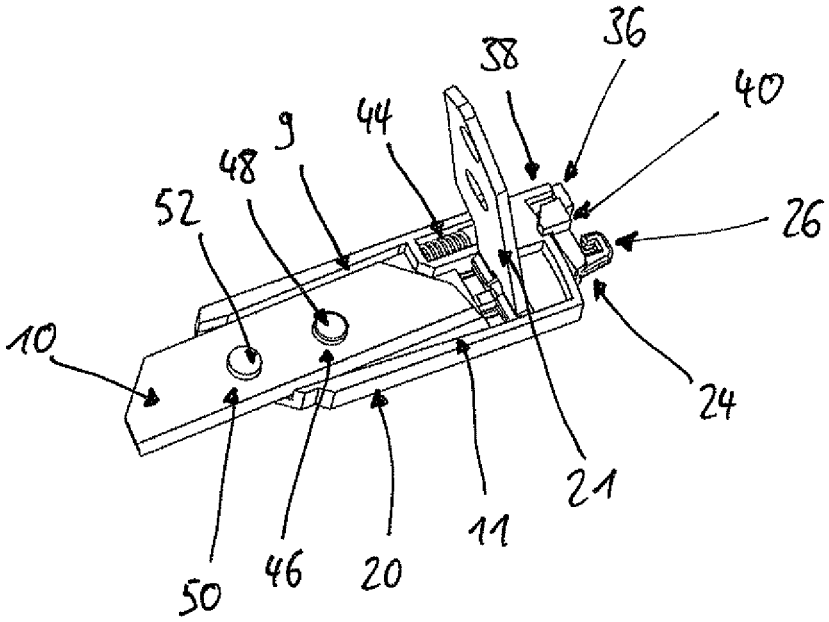
Fig. 3b

Fig. 4a
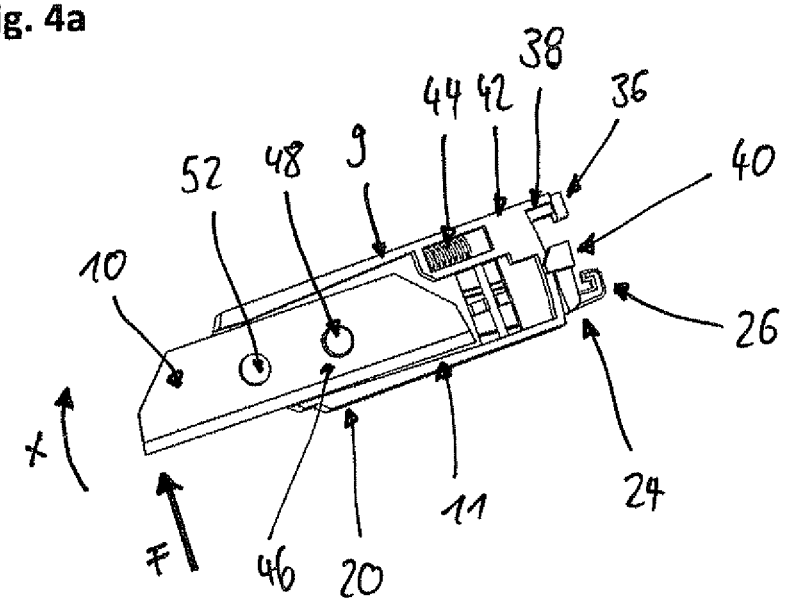
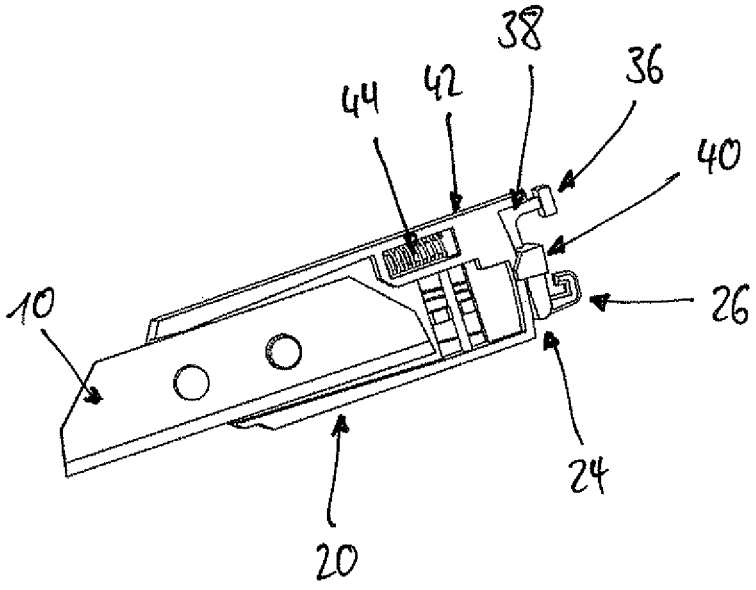
Fig. 4b

Fig. 5a
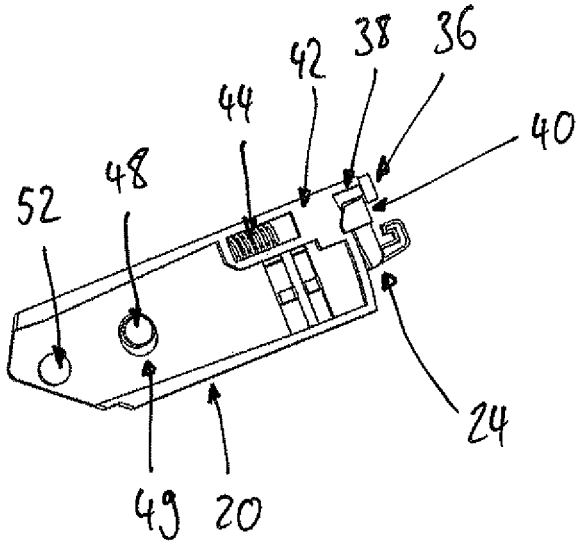
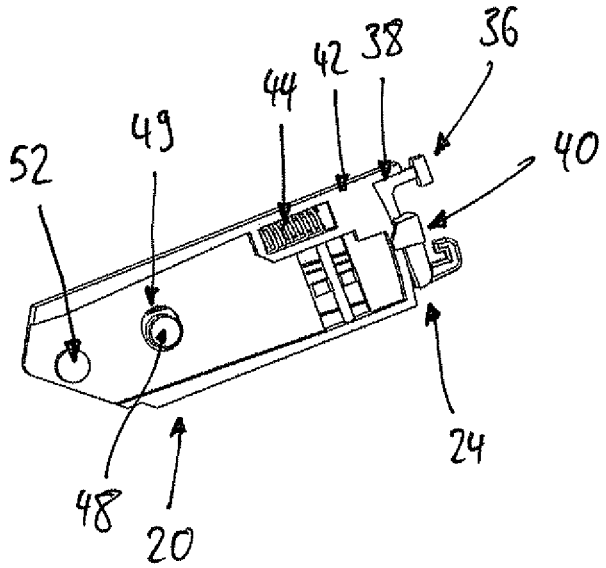
Fig. 5b

Fig. 7a
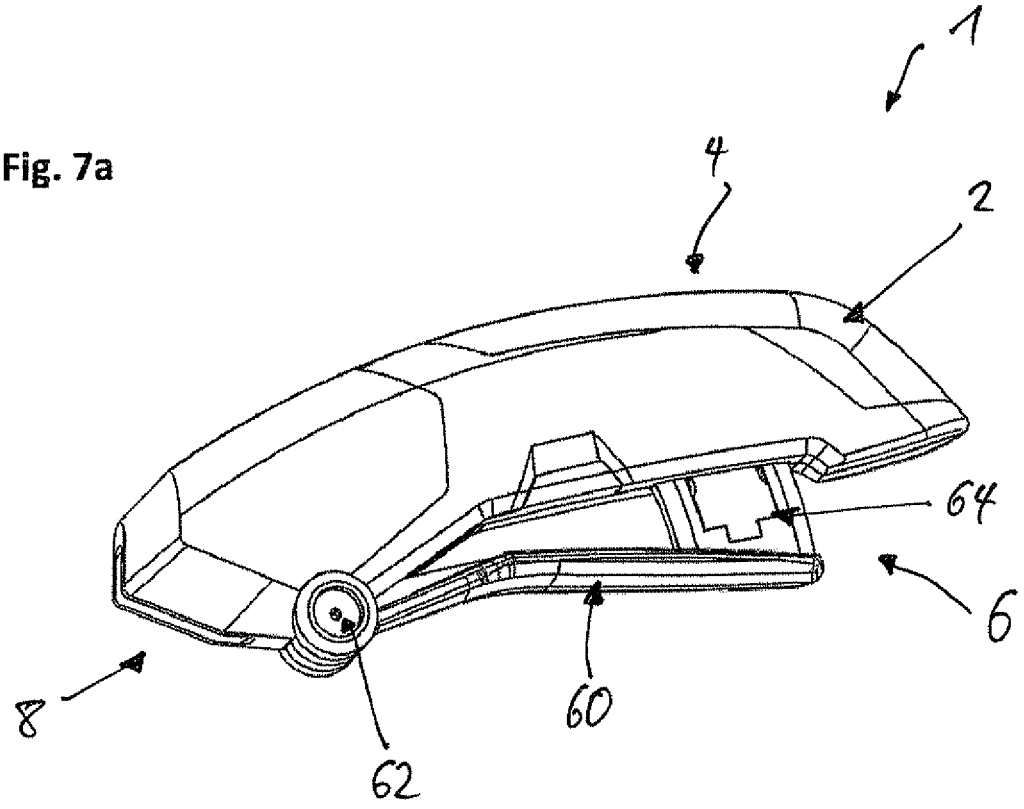
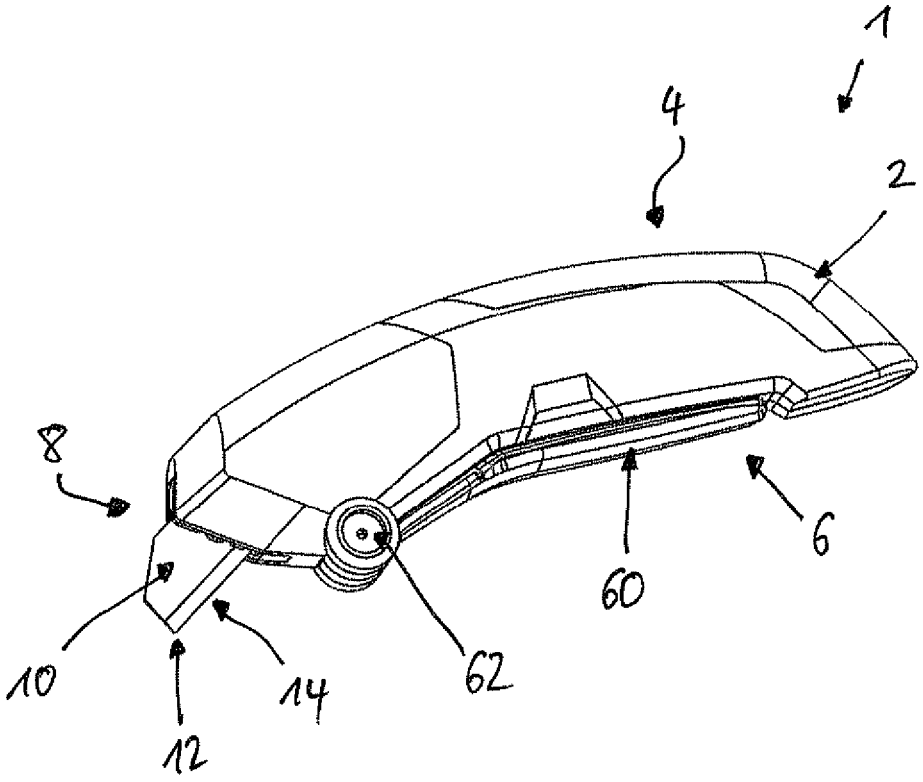
Fig. 7b

Fig. 8a
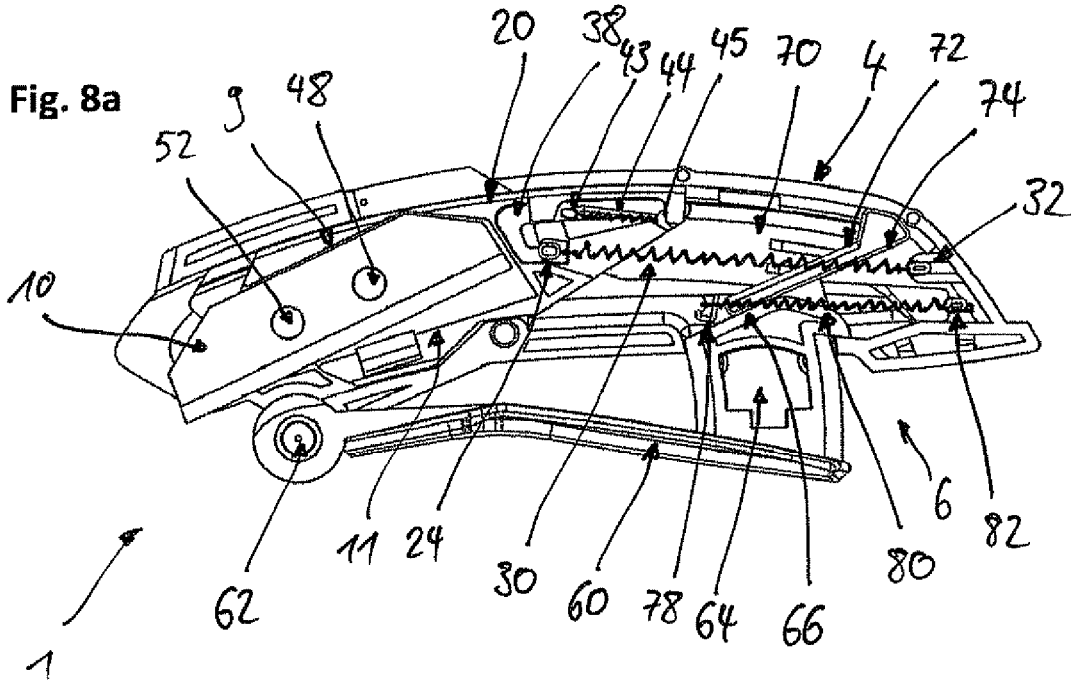
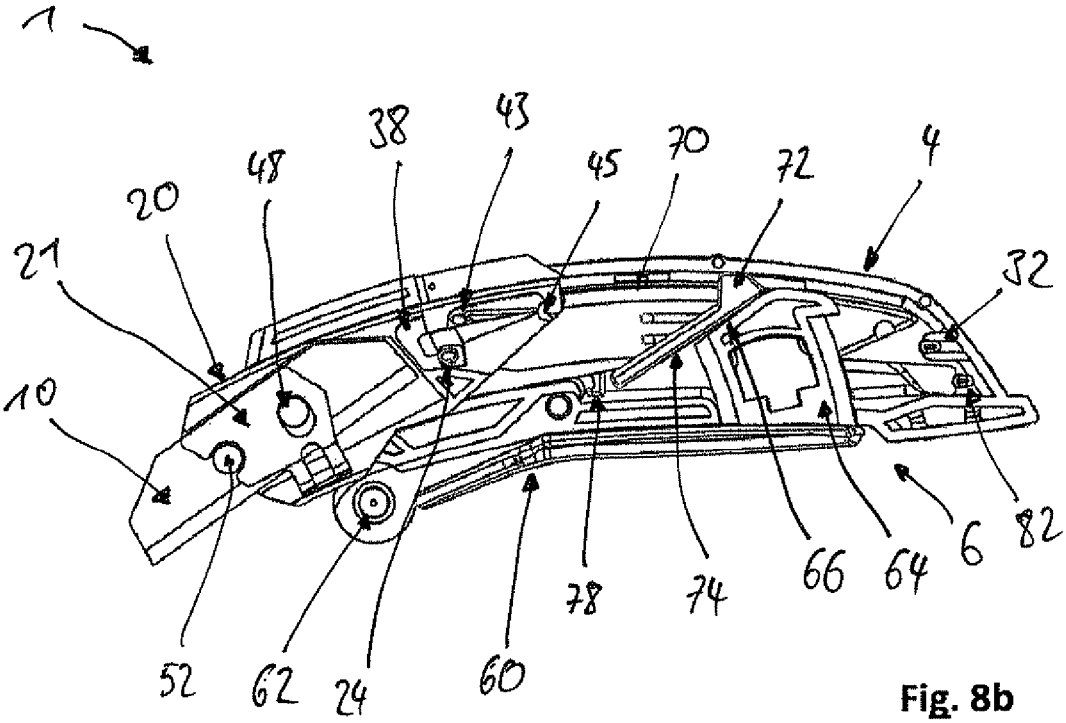
Fig. 8b

Fig. 8c
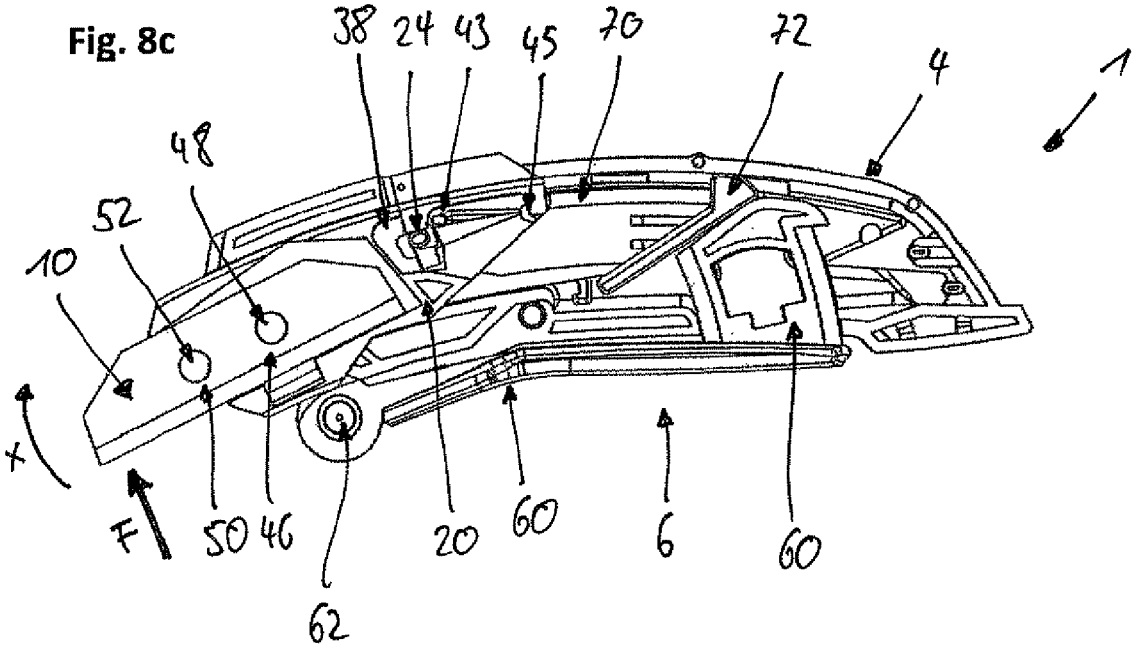
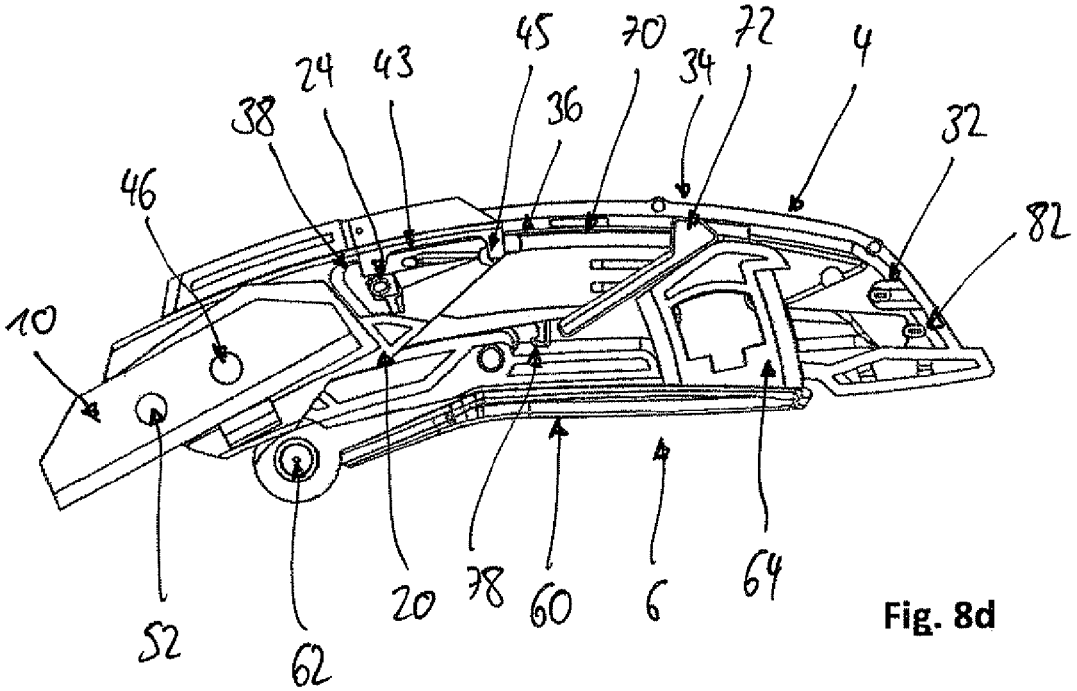
Fig. 8d

Fig. 8e
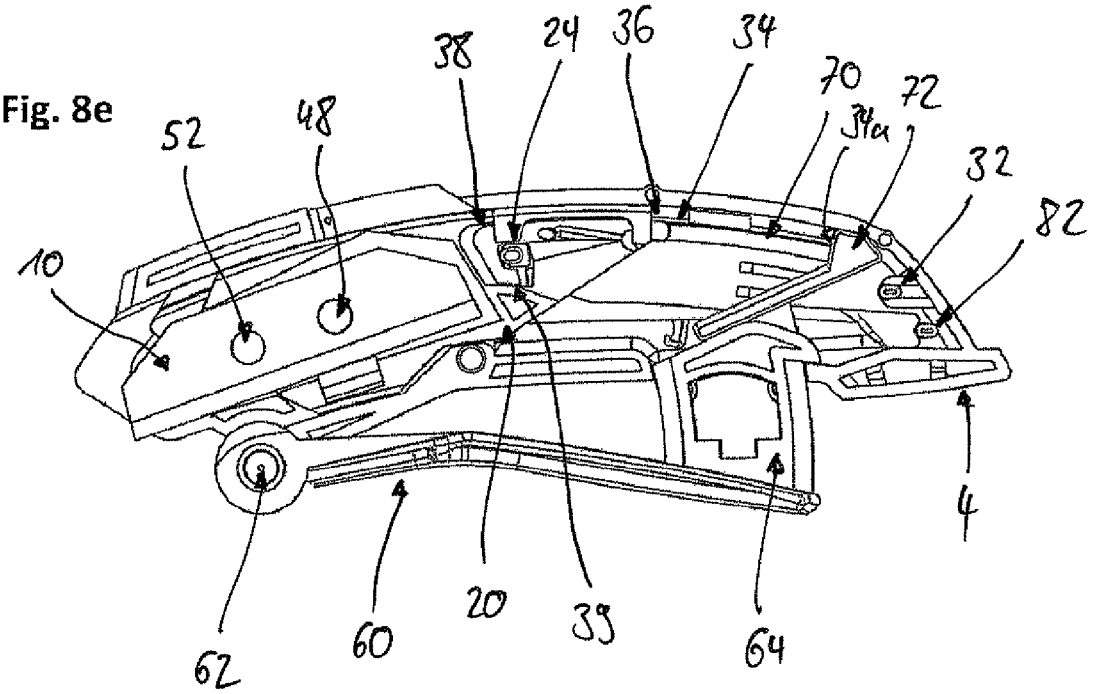
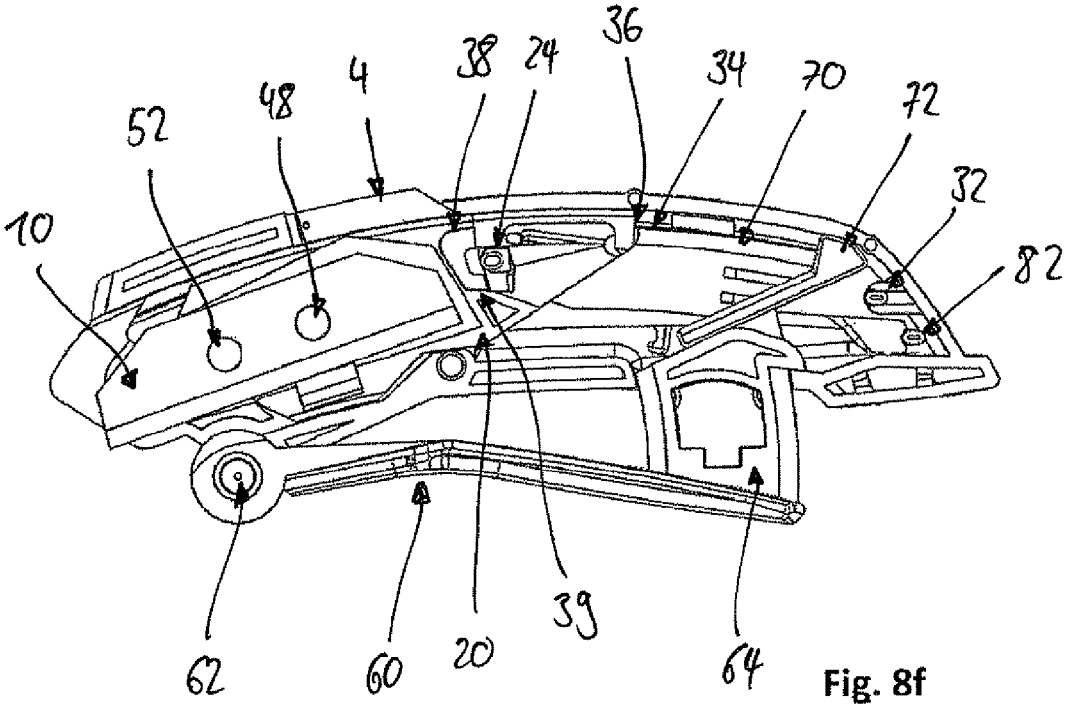
Fig. 8f

Fig. 9a
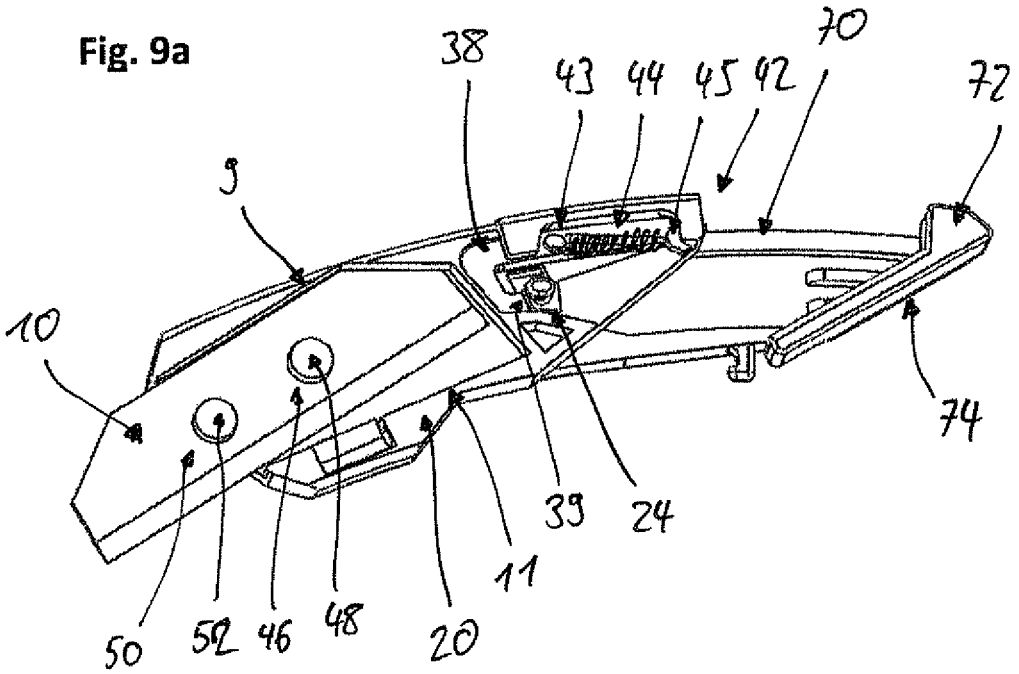
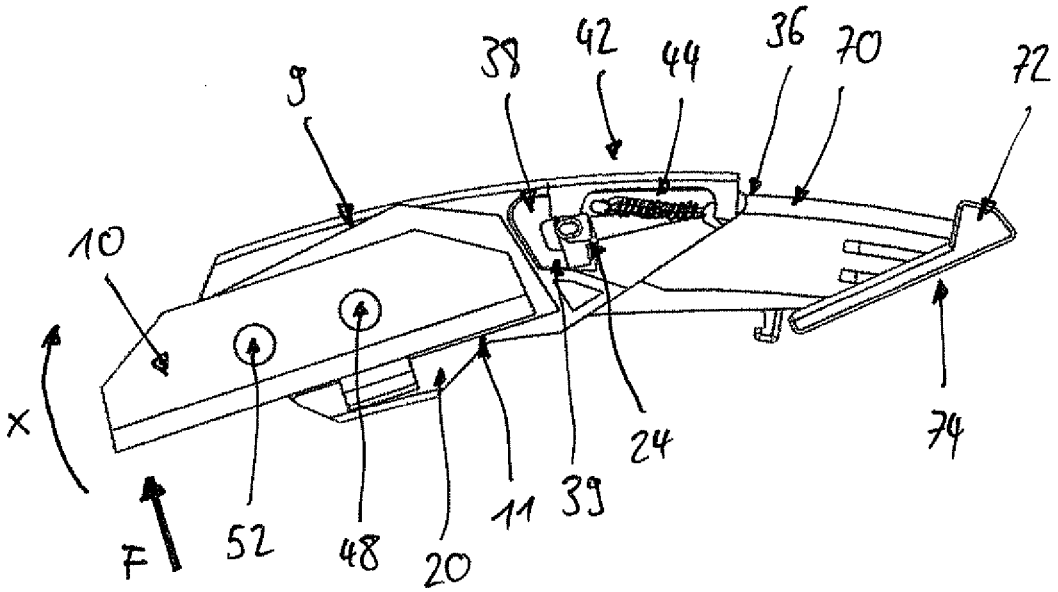
Fig. 9b

Fig. 10a
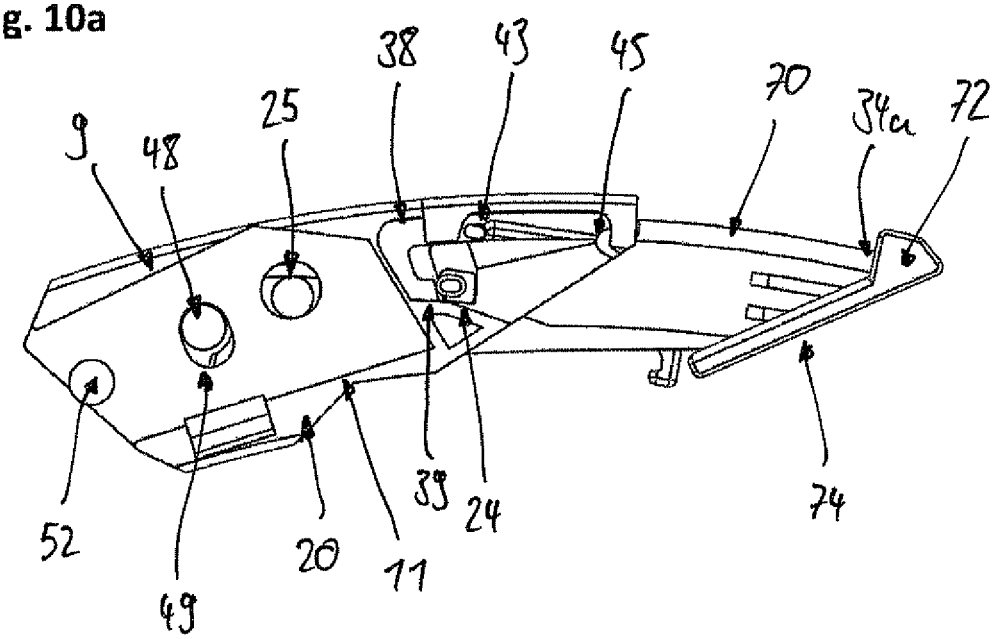
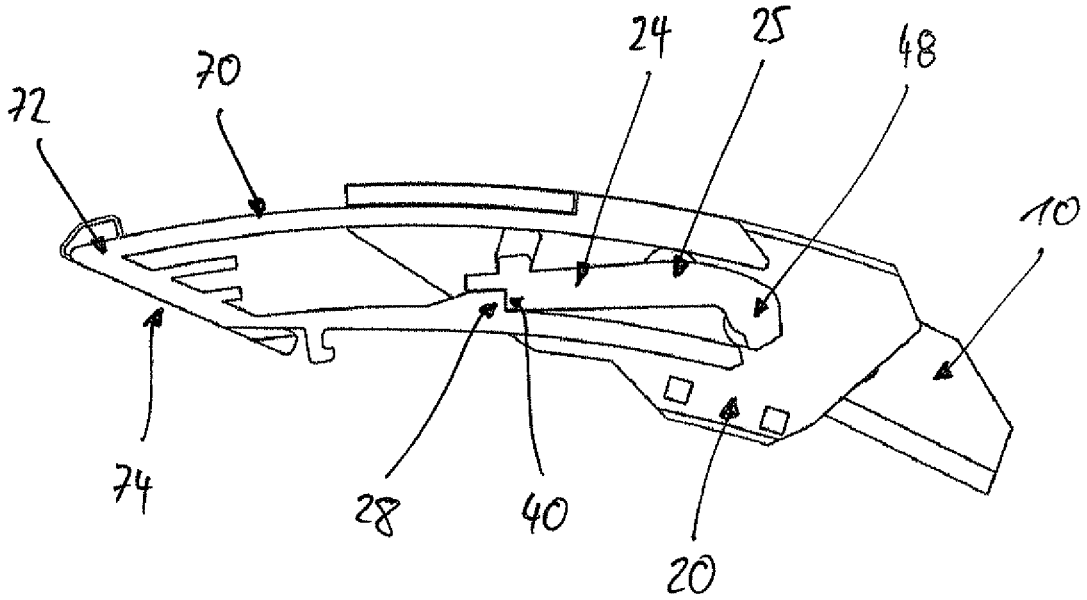
Fig. 10b

Fig. 10c
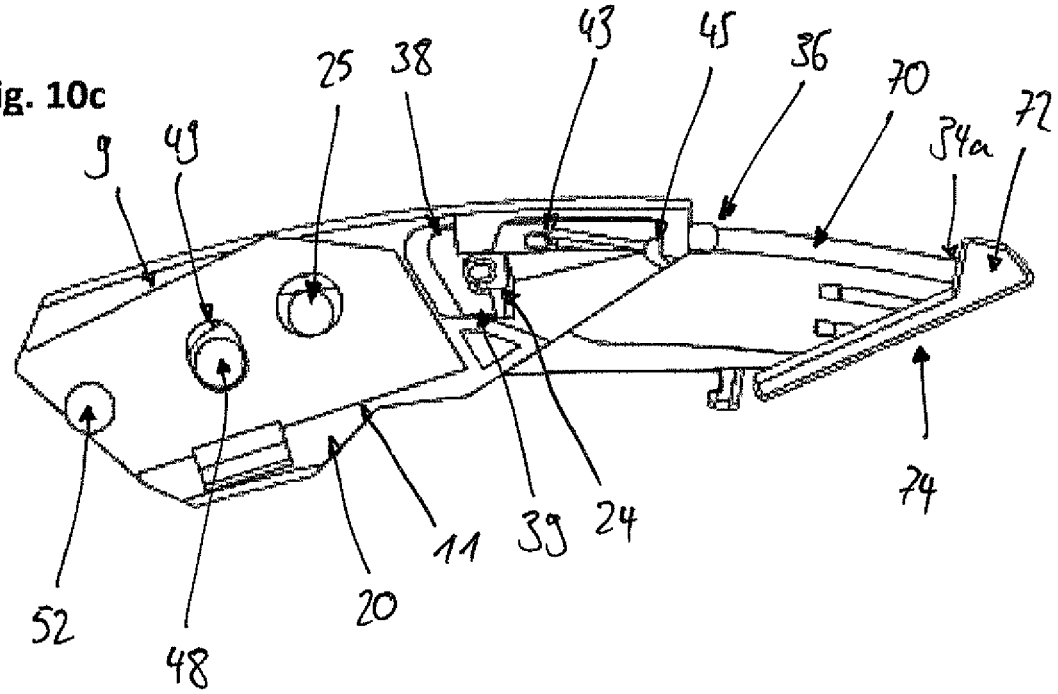
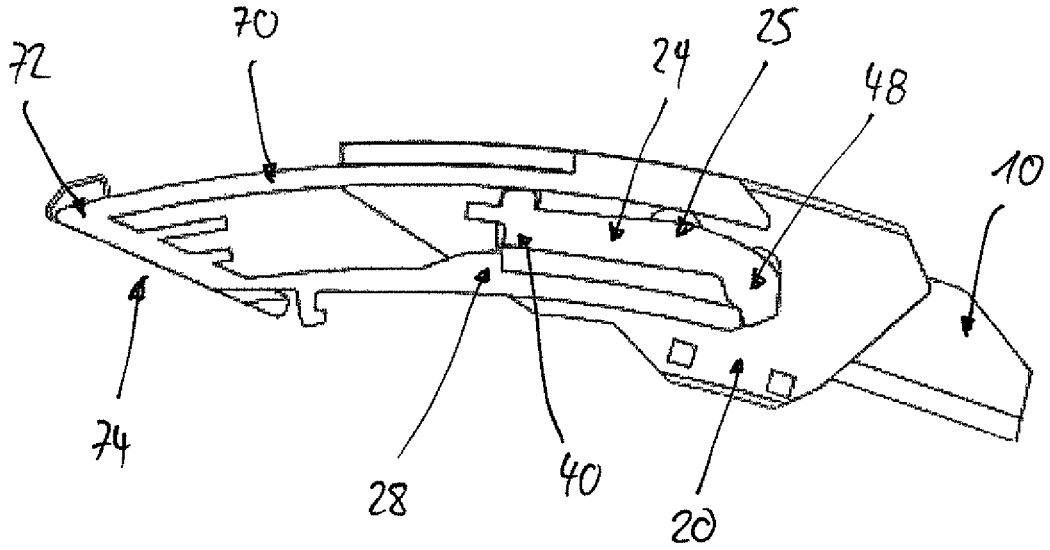
Fig. 10d

SAFETY KNIFE

TECHNICAL FIELD

The present invention concerns a knife comprising a housing, a blade slider which is mounted to the housing and is reciprocable by means of an actuating device between a safety position and a cutting position, a return element for applying a return force to the blade slider in the direction of the safety position, and a blade arranged on the blade slider. The invention further concerns knife housing comprising a blade slider which is mounted in the housing and is reciprocable by means of an actuating device between a safety position and a cutting position, and a return element for applying a return force to the blade slider in the direction of the safety position.

BACKGROUND

Knives of the kind set forth hereinbefore are used in many cases for cutting materials, such as for example paper, cardboard, film, textiles, and the like. A blade, which is generally in the form of a strip steel interchangeable blade with a straight cutting edge, is arranged in that case on a blade slider. The blade slider is displaceable by means of a slider member or handle from outside the housing in such a way that the blade is moved in a front portion out of the housing and can thus be used for cutting. The slider member is generally of such a configuration that the slider member can be actuated by a user with a thumb or index finger. Then, after the slider member is released, the blade is automatically pulled back into the housing again by means of a return element acting on the slider member or the blade slider. An earlier knife of that kind is known, for example, from DE 36 22 342 A1. In that knife, the slider member is connected to the blade slider in such a way that a user has to release the actuating device so that the blade automatically moves back into the housing again.

Besides those knives in which the blade slider is rigidly connected to the slider member, such knives are also known that have a triggerable mechanism which, when triggered by a cutting reaction force, uncouples the blade slider and the slider member so that the blade slider automatically moves back into the housing after the cutting reaction force ceases. Cessation of the cutting reaction force can be afforded, for example, by sliding the knife off the material to be cut. Knives of that kind are therefore also referred to as safety knives.

A safety knife of that kind is known, for example, from DE 19 723 279 C1. In that safety knife, the blade carrier can be coupled to the actuating device in the form of a slider member, by means of a flexible plate, in such a way that the blade carrier and the slider member are coupled upon being extended. In the cutting operation, a cutting reaction force acts on the blade, which is rigidly connected to the blade slider, and that cutting reaction force causes an additional relative movement of the blade and the blade slider in the extension direction relative to the slider member. By virtue of that relative movement of the blade slider, the blade slider is uncoupled from the slider member so that the blade slider together with the blade automatically moves back into the housing after the conclusion of the cutting operation by means of the return element, even if the slider member is not released by the user.

A further knife of that kind is known from EP 1 864 766 B1. In that knife, the blade slider is mounted rotatably in the housing in such a way that in the extended position, the blade slider is rotated by virtue of the cutting reaction force, whereby a rear portion of the blade slider, that is opposite to the blade, comes out of engagement with a portion of the actuating device which is in the form of the slider member, and automatically moves back into the housing after the conclusion of the cutting operation. In addition, a locking spring portion is arranged on the end of the blade slider opposite to the blade, which passes over a rib on the housing when the blade slider is rotated so that, in order to safely slide back into the housing, the blade slider is held in the rotated position by means of that rib and cannot come into engagement again with the actuating device when the cutting reaction force ceases to be applied.

In both known safety knives, uncoupling of the blade slider and the actuating device requires a relatively large amount of force or cutting reaction force, and thus cutting force. In the case of the knife known from DE 19 723 279 C1, that cutting force is the frictional force between the blade and the material to be cut, while in the case of the knife disclosed in EP 1 864 766 B1 this force is the force with which the knife is pressed against the material. Therefore, with both knives the safety aspect can be improved when cutting thin materials, as the triggerable mechanism, which provides that the blade slider and the actuating device are uncoupled, is not triggered because of an inadequate cutting reaction force.

SUMMARY

The object of the present invention is to provide a knife which is improved over the known knives. In particular, the object of the invention is to provide a knife which affords enhanced safety, particularly when cutting materials which are easy to cut and when cutting with a low cutting force.

In a knife of the kind set forth in the opening part of this specification that object is attained in that the blade is mounted rotatably to the blade slider.

According to the invention, the blade is rotatable while the blade slider, with respect to the housing, is not rotatable. In that way, the force necessary for uncoupling is substantially reduced as it is not the entire blade slider that has to be rotated. In addition, the rotary movements of the blade on the blade slider and the movement of the blade slider along a path of movement between the cutting position and the safety position are decoupled from each other, whereby the blade slider can be guided substantially more precisely on the path of movement. For that purpose, the housing preferably has a guide for guiding the blade slider. Insofar as the movements of the blade and the blade slider are independent of each other, both handling is improved, and also the safety aspect of a blade according to the invention is enhanced. Accordingly, in the cutting position, there has to be substantially no or only slight play for the blade slider in the guide as only the blade is rotated on the blade slider. That improves the safety of the knife.

The knife preferably has a triggerable mechanism for decoupling the blade slider and the actuating device, preferably by virtue of a cutting reaction force, so that the blade slider is moved back together with the blade by means of the return element. Such a triggerable mechanism can also be referred to as an uncoupling device.

The path of movement of the blade slider between the safety position and the cutting position can be linear or also curved. A curved path of movement leads to an ergonomically improved knife which lies better in the hand. The housing is preferably of such a configuration that the blade slider is substantially enclosed by the housing so that it can be moved in a protected condition. The actuating device is then arranged so that the actuating device is manually accessible to the user by means of a portion from outside the housing and, by means thereof, the blade slider and the blade are movable from the safety position into the cutting position. Preferably, only the blade extends from the housing in the cutting position while the blade slider remains within the housing.

Preferably, an abutment or the like is provided for limiting the direction of extension of the blade slider and blade. The blade is preferably in the form of a steel strip interchangeable blade, and has a straight or slightly curved cutting edge. Preferably, the housing can be easily opened so that the blade can be rapidly changed in the case of becoming blunt. The return element is preferably of such a configuration and arrangement that the return force for returning the blade slider to the safety position is always applied. Such a return element can be, for example, in the form of a tension or compression spring, a rubber band, a coil spring, a magnet, or the like. Any element for applying a return force can be used and is in accordance with the invention. Particularly, the blade is preferably mounted rotatably to the blade slider in such a way that the blade is pivotable on the blade slider, namely being reciprocable or rotatable to and fro between two positions. The axis of rotation or pivotal movement of the blade is in this case arranged perpendicularly relative to the cutting plane.

In accordance with a first particularly preferred embodiment, the knife has a coupling element connected to the blade slider and/or the actuating device so that the blade slider and the actuating device are coupled together upon a movement of the blade slider from the safety position into the cutting position, and are uncoupled in the cutting position by means of a rotary movement of the blade relative to the blade slider, so that the blade slider is restored to the safety position by means of the return element. Such a coupling element can be, for example, in the form of a projection arranged on the actuating device, or can have such a projection which cooperates with the blade slider for moving same from the safety position into the cutting position, or which also acts directly on the blade. Alternatively, the coupling element is connected movably to the blade slider or the actuating device, and is movable between an engagement position for moving the blade slider from the safety position into the cutting position, and into a disengagement position by means of a rotary movement of the blade so that the blade slider can be moved back into the safety position by means of the return element. Particularly, the blade is preferably mounted rotatably to the blade slider in such a way that the rotary movement is caused by a cutting reaction force during a cutting operation.

Preferably, the coupling element is mounted pivotably to the blade slider and is in engagement with the blade so that the coupling element is pivotable by the rotary movement of the blade. Particularly, the coupling element is preferably mounted pivotably to the blade slider in such a way that disengagement of the blade slider from the actuating device is caused by means of a pivotal movement of the coupling element. The structure is substantially simplified thereby, as the coupling element is easily connected to the blade slider and can easily come into engagement or come out of engagement with the actuating device. In that way, the blade is also not fixedly connected to the coupling element so that the blade can be easily replaced.

In accordance with a further preferred embodiment, the coupling element is of a substantially bar-shaped configuration and is in the form of a lever, wherein a coupling portion for coupling to the actuating device that is remote from the blade is arranged at an end of the coupling element. Preferably, the coupling element is arranged pivotably on the blade slider with the end that is towards the blade. In this embodiment, the actuating device preferably includes a coupling portion with which the actuating device can couple to the coupling portion of the coupling element. Such a coupling portion of the actuating device can be, for example, in the form of a projection or engagement surface which can be pressed against the coupling portion of the bar-shaped coupling element so that the blade slider is moved from the safety position into the cutting position. The bar-shaped coupling element is preferably oriented substantially along the path of movement of the blade slider. That is to say, substantially along a longitudinal axis of the knife. The coupling element is pivotable to and fro between two positions, wherein the coupling element is so arranged in the first position that the coupling element can come into engagement with the coupling portion of the actuating device for moving the blade slider from the safety position into the cutting position. Then in the cutting position, the coupling element, by virtue of a rotary movement of the blade relative to the blade slider, is pivoted into a second position. Thus, the coupling portion of the coupling element and the coupling portion of the actuating device are uncoupled from each other and the blade slider is moved back into the safety position by means of the return element. The blade is preferably in engagement in a portion with the coupling element, which is arranged between the pivotable mounting and the engagement portion of the coupling element. Preferably, that portion is arranged closer to the pivotable mounting than to the coupling portion. Thus, the coupling element acts particularly well as a lever and only a slight rotary movement of the blade leads to a pivotal movement of the coupling element that is relatively great in relation thereto, so that the coupling element is reliably uncoupled from the coupling portion of the actuating device. Alternatively, the blade is connected in an end portion to the bar-shaped coupling element, and the rotary mounting of the coupling element is between the end portion and the coupling portion. In that way, the coupling element also effectively acts as a lever, but it is pivoted in the opposite direction. Preferably the coupling portions, and in particular the contact surface for coupling purposes, are small so that even a slight deflection of the coupling element leads to reliable uncoupling. That further improves the safety aspect of a knife according to the invention.

In a preferred development of the knife, the return element is in the form of a tension spring connected with one end to the coupling element and with the other end to the housing. Thus, the blade slider is returned to the safety position by way of the coupling element, which is connected to the spring. That spring can be arranged so that a pivotal movement of the coupling element, triggered by the rotary movement of the blade, is further assisted by the spring. Thus, uncoupling of the coupling element from the actuating device is possible with even less force, whereby the safety aspect of such a knife is further improved. Alternatively, the spring can be arranged so that the spring opposes a pivotal movement of the coupling element, and thus uncoupling. That can be preferred if the knife is to be used for cutting firm articles for which a high cutting force is necessary. Preferably, the spring is also arranged so that the coupling element is pivoted after return of the blade slider into the safety position in such a way that the coupling element can couple again to the actuating device. That further improves simple reliable operation of the knife, and the knife can be actuated again directly after the return movement of the blade slider.

If the actuating device has a coupling portion which is in the form of a projection, and which cooperates with the coupling portion of the coupling element, which coupling portion is in the form of an abutment surface in the end region of the coupling element, it is further preferred to move the blade slider from the safety position into the cutting position. That is a particularly simple structural possibility of designing the engagement between the actuating device and the coupling element. The actuating device can be, for example, in the form of a slider member or the like. Alternatively, the actuating device is, for example, in the form of a so-called pincer grip which drives an actuating element by way of an inclined plane in such a way that the blade slider is moved from the safety position into the cutting position.

In a particularly preferred embodiment, the knife has a safety element for holding the coupling element in a pivoted position, at least on a portion of the path of movement of the blade slider, between the cutting and safety positions. Preferably, the coupling element is held by the safety element, and in particular, exclusively upon a movement from the cutting position into the safety position. The expression "pivoted position" refers here to the position in which the coupling element is uncoupled from the actuating device. That prevents re-coupling after uncoupling by the rotary movement of the blade. That substantially enhances the safety aspect of the knife. Accordingly, the blade slider is firstly extended, by means of the actuating device, from the safety position into the cutting position with the coupling element and the actuating device being coupled. According to the invention, when performing a cutting operation, the blade rotates relative to the blade slider by virtue of the cutting reaction force, whereby the coupling element is pivoted and uncoupled from the actuating device. Even if a user now further actuates the actuating device, the blade slider is moved back by means of the return element, in which case the safety element provides that the coupling element cannot be pivoted back again, and thus couples to the actuating device when the cutting reaction force ceases to be applied. Cessation of the cutting reaction force can occur, for example, by virtue of slipping off a material to be cut.

In a preferred development of the knife, the safety element is arranged movably on the blade slider. In particular, the safety element is preferably arranged slidably on the blade slider. As the coupling element is also arranged on the blade slider, the safety element is thus always in the correct position relative to the coupling element, and can hold the coupling element securely after pivotal movement in that pivoted position. Even if a user does not completely extend the blade or the blade slider for using the knife, the blade can rotate and the coupling element can pivot. Even in such a situation, the safety element is in the correct position relative to the coupling element, and can hold the coupling element in the pivoted position. That further improves the safety of a knife according to the invention.

In a preferred development, the safety element is mounted to the blade slider so that, upon uncoupling of the coupling element from the actuating device, the safety element moves into the path of movement of the coupling element in such a way that the pivoted position of the coupling element is maintained between the cutting position and the safety position on at least a portion of the path of movement of the blade slide. In that way, the coupling element is particularly easily held in the pivotal position and re-coupling is effectively prevented.

In a further preferred embodiment, the knife has a tensioning element for pretensioning the safety element, wherein the safety element is released by uncoupling of the coupling element from the actuating device, and is moved by means of the tensioning element into the path of movement of the coupling element. Such a tensioning element can be, for example, in the form of a tension spring, compression spring, elastomer, magnet, or the like. For example, the coupling element may have a projection which holds the safety element in the pretensioned condition. By pivotal movement of the coupling element, that projection is also pivoted so that the safety element is moved by means of the tensioning element, and is moved in front of that projection so that the coupling element cannot pivot back again. Alternatively, the safety element can also engage into a recess on the coupling element, which recess is cleared by a pivotal movement of the coupling element.

In a further preferred embodiment, the blade has a first through opening through which a projection on the blade slider passes, and a second through opening through which a projection on the coupling element passes. In this embodiment, the blade is mounted in the blade slider rotatably, and in particular pivotably, by means of the first through opening. The blade is in engagement with the coupling element by means of the second through opening so that the blade is pivotable by means of a rotary movement of the blade. The blade can thus be easily replaced and the through bores easily provide for mounting the blade rotatably to the blade slider on the one hand, and affording engagement with the coupling element on the other hand. Preferably, both projections are substantially cylindrical.

It is further preferred that the blade slider has a blade rotation limiting means for limiting a rotary movement of the blade relative to the blade slider. Preferably, the blade rotation limiting means is of such a configuration that the blade rotation limiting means permits a rotary movement of the blade which is as small as possible. Preferably, the blade is rotated as little as necessary, but to such an extent that the coupling element is pivoted in such a way that the coupling element is uncoupled from the actuating device. Because the cutting operation is influenced by a rotary movement of the blade, even if slightly, it is preferable for the blade to be rotated as little as possible. A user of the knife should not be rendered uncertain and confused by an excessively great blade rotation and diverted from the cutting operation. By keeping the blade rotation as small as possible, safety of the knife according to the invention is further improved. Such a blade rotation limiting means can be, for example, in the form of a projection against which the blade bears, or also in the form of an abutment for the coupling element, which is in engagement with the blade. The blade may be rotatable, e.g., by 3°.

In a further preferred embodiment, the coupling element is arranged on a side of the blade slider that is opposite to the blade. Accordingly, the blade slider is disposed between the blade and the coupling element. Preferably, the blade slider has a projection that cooperates with the first through opening in the blade as a rotary mounting for the blade. In addition, the blade slider has a through opening through which a projection on the coupling element projects into a through opening in the blade, so that the blade is in engagement with the coupling element. The blade can be even more easily replaced by virtue of that arrangement, which simplifies use of a knife according to the invention.

In a further particularly preferred embodiment, the knife has a device for moving the safety element out of the path of movement of the coupling element while the blade slider is in the safety position, so that the coupling element can couple to the actuating device. In that way, the knife is ready for operation again, and the blade slider can be extended again with the actuating device from the safety position into the cutting position. Such a device can be, for example, in the form of an abutment which displaces the safety element again so that the coupling element can pivot back.

In a further aspect of the invention, the object is attained in relation to a knife housing of the kind set forth in the opening part of this specification, insofar as the knife housing has a blade slider which is mounted to the housing and is reciprocable by means of an actuating device between a safety position and a cutting position, a return element for applying a return force to the blade slider in the direction of the safety position, and a coupling element. The coupling element is so connected to the blade slider and/or the actuating device that the blade slider and the actuating device are coupled together upon a movement of the blade slider from the safety position into the cutting position, and are uncoupled in the cutting position by means of a pivotal movement of the coupling element so that the blade slider is restored to the safety position by means of the return element. To this end, the blade slider is adapted to receive a blade in such a way that the blade is arranged rotatably on the blade slider and the coupling element is pivotable by means of a rotary movement of the blade. Preferably, the coupling element is of such a configuration and arrangement that the coupling element is in engagement with a blade to be arranged there. Preferably, the blade slider is adapted to receive a steel strip interchangeable blade. Consequently, with such a knife housing, there is no need to rotate the entire blade slider in order to trigger the mechanism for returning the blade slider to the safety position, that is to say an uncoupling device, but that is triggered by means of a rotary movement of the receivable blade. That substantially enhances the safety of the knife housing according to the invention, and in particular, a knife housing in which a user has arranged a blade.

Particularly, the knife housing is preferably designed so that the knife housing is adapted for a knife according to the one of the preceding preferred embodiments of a knife. For the advantages of the knife housing, reference is directed to the above-described embodiments of a knife according to the invention.

BRIEF DESCRIPTION OF THE DRAWINGS

The invention is described hereinafter by means of two embodiments by way of example with reference to the accompanying Figures in which:

FIG. 2*a* shows the knife of FIG. 1*a* with an opened housing,

FIG. 2*b* shows the knife of FIG. 2*a* with the blade extended,

FIG. 2*c* shows the knife of FIG. 2*b* with a rotated blade and a pivoted coupling element, FIG. 2*d* shows the knife of FIG. 2*c* with a displaced safety element, FIG. 2*e* shows the knife of FIG. 2*d* with a returned blade slider, FIG. 2*f* shows the knife of FIG. 2*e* with a pushed-in safety element, FIG. 3*a* is a first view of a blade slider with a blade, FIG. 3*b* is a second view of the blade slider of FIG. 3*a*, FIG. 4*a* shows the blade slider of FIG. 3*a* with a rotated blade and a pivoted coupling element, FIG. 4*b* shows the blade slider of FIG. 4*a* with a displaced safety element, FIG. 5*a* shows the blade slider without a blade, FIG. 5*b* shows the blade slider of FIG. 5*a* with a pivoted coupling element, FIG. 7*a* is a first view of a knife according to a second embodiment, FIG. 7*b* shows the knife of FIG. 7*a* with an extended blade, FIG. 8*a* shows the knife of FIGS. 7*a* and 7*b* with an opened housing, FIG. 8*b* shows the knife of FIG. 8*a* with an extended blade, FIG. 8*c* shows the knife of FIG. 8*b* with a rotated blade and a pivoted coupling element, FIG. 8*d* shows the knife of FIG. 8*c* with a displaced safety element, FIG. 8*e* shows the knife of FIG. 8*d* with a returned blade slider, FIG. 8*f* shows the knife of FIG. 8*e* with a pushed-in safety element, FIG. 9*a* shows a blade slider with a blade in a second embodiment, FIG. 9*b* shows the blade slider with a blade of FIG. 9*a* with a rotated blade and a pivoted coupling element, FIG. 10*a* is a first view of a blade slider, FIG. 10*b* is a second view of the blade slider of FIG. 10*a*, FIG. 10*c* shows the blade slider of FIG. 10*a* with a pivoted coupling element and a displaced safety element, and FIG. 10*d* shows the blade slider of FIG. 10*b* with a pivoted coupling element.

DETAILED DESCRIPTION

Figure 1A:
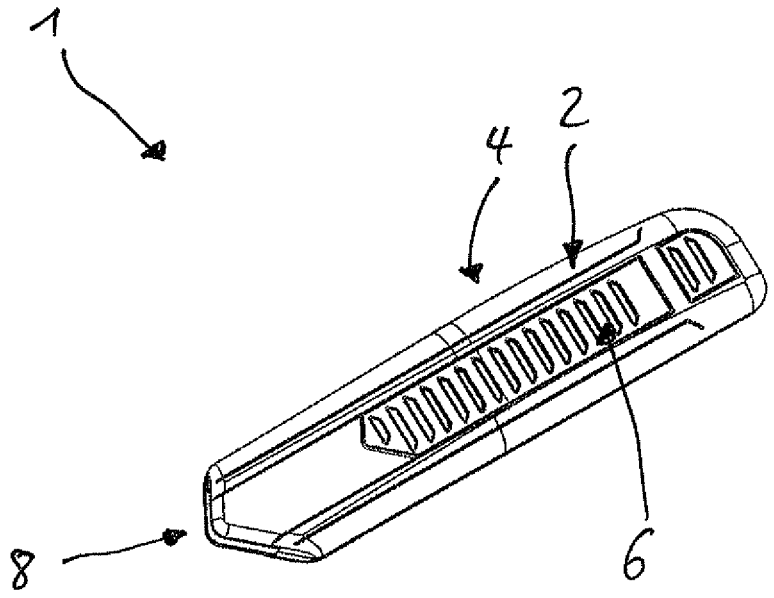
FIG. 1*a* shows a knife according to a first embodiment.
Figure 1B:
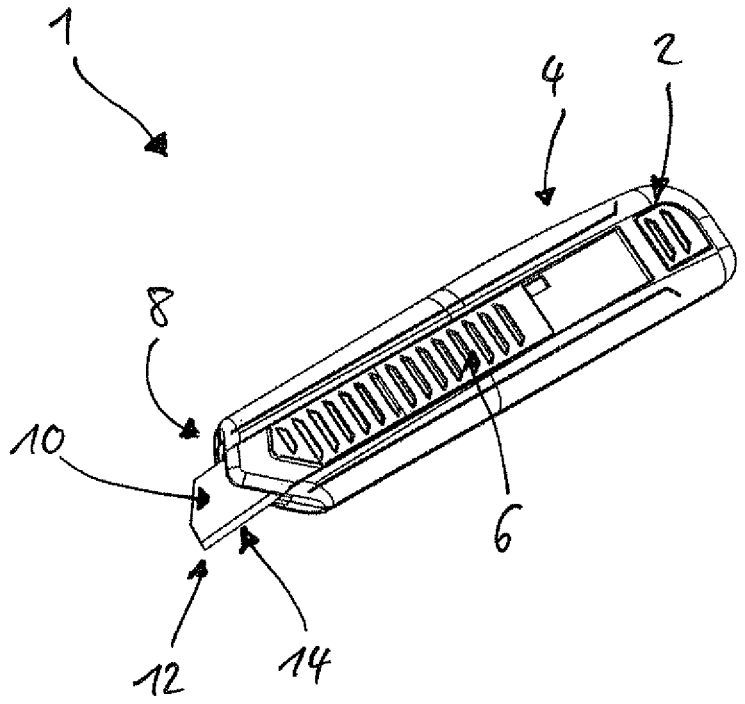
FIG. 1*b* shows the knife of FIG. 1*a* with a blade extended.

A knife 1 as shown in FIGS. 1*a* and 1*b* has in an assembled condition, a two-part housing 2, 4, and an actuating device 6, which in this embodiment is in the form of a sliding handle member. At a front portion, the housing 2, 4 has an opening 8 through which a blade 10 can be pushed manually out of the housing 2, 4 by means of the actuating device 6. As shown in FIG. 1*a*, the blade is arranged in a safety position of being retracted into the housing, while the actuating device 6 or sliding handle member is arranged in a retracted position. In contrast, in FIG. 1*b* the blade 10 is arranged in a cutting or extended position, and the actuating device 6 is accordingly pushed forwardly—manually. The blade 10 further has a blade tip 12, and a cutting edge 14. The housing may be made of one piece, or alternatively, of a plurality of parts.

FIGS. 2*a* through 2*f* show the knife 1 with an opened housing 2, 4. The top side of the housing 2 is removed in these Figures. In addition, FIGS. 2*a* through 2*f* show the movements involved in extension of the blade 10, rotation of the blade 10, and return of the blade slider 20.

Figure 6:
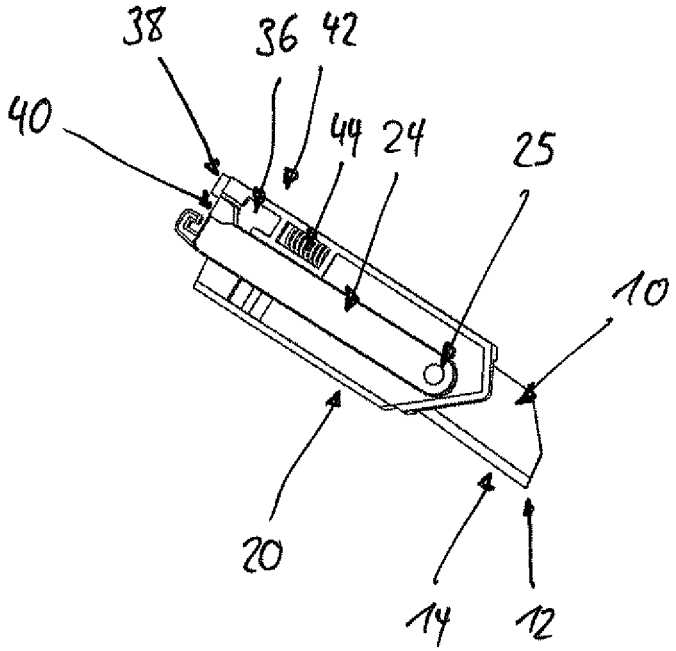
FIG. 6 is a further view of the blade slider with a blade.

A blade slider 20 is arranged on the housing half 4 in a guide 22 (FIG. 2*a*). The blade slider 20 is reciprocable by means of the guide 22 between the safety position (FIGS. 2*a*, 2*e*, 2*f*) and the cutting position (FIGS. 2*b* through 2*d*). A coupling element 24 is mounted pivotably to the blade slider 20. The coupling element 24 is arranged behind the blade slider 20 as illustrated in FIGS. 2*a* through 2*f* (see in that respect FIG. 6). The coupling element 24 is substantially bar-shaped and has a coupling portion 40 for coupling to the actuating device 6 at a rear end remote from the blade 10. For that purpose, the actuating device 6 has a coupling portion 28, which here is in the form of a projection of square cross-section. Upon actuation of the actuating device 6, that is to say, upon displacement of the sliding handle member, the coupling portion 28 is moved from right to left in relation to FIG. 2*a*, and in that movement presses against the coupling portion 40 of the coupling element 24, and thus moves the blade slider 20 from the safety position (shown in FIG. 2*a*) into the cutting position (in FIG. 2*b*). The movement of the blade slider 20 from the safety position (FIG. 2*a*) into the cutting position (FIG. 2*b*) provides for tensioning the return element 30, which here is in the form of a spring. The spring 30 is connected with one end to a hook 26 of the coupling element 24, and with the other end to a portion 32 of the housing 4. The blade slider 20 is thus pretensioned in the direction of the safety position. In addition, a safety element 38 is arranged displaceably in a recess 42 on the blade slider 20. The safety element 38 is pretensioned by means of a compression spring 44 in such a way that the safety element 38 is displaceable by means of the spring 44 out of the recess 42 and away from the blade 10. If the coupling element 24 is not pivoted, that is to say, the coupling element 24 is in a coupling position (as shown in FIGS. 2*a* and 2*b*), the safety element 38 is held in the recess 42 by means of the coupling element 24, and cannot be moved out of the recess 42 by means of the spring 44.

In this embodiment, the blade 10 has two circular through openings 46, 50. The blade 10 is mounted rotatably, in particular pivotably, to the blade slider 20 by means of a projection 52, by way of the first through opening 50 which is arranged closer to the blade tip 12. For that purpose, the projection 52 is cylindrical and projects from the blade slider. By way of the second through opening 46, which is spaced relative to the blade tip 12, the blade 10 is in engagement with the coupling element 24, which also has a projection 48 passing through the through opening 46.

When a force F (see FIG. 2*c*), for example in the form of a cutting reaction force, is applied to the blade 10, the blade 10 is rotated about the cylindrical projection 52 in the x-direction, whereby the coupling element 24 is pivoted. In that respect, the coupling portion 40 pivots downwardly in relation to FIG. 2*c*. In that way, the coupling element 24 is uncoupled from the coupling portion 28 of the actuating device 6 (see in particular FIGS. 2*c* through 2*f*). As now the blade slider 20 is no longer held in the cutting position by way of the coupling element 24 and the coupling portion 48 by means of the actuating device 6, the blade slider 20 is moved back into the safety position by means of the tensioned spring 30 (see FIG. 2*e*). At the same time, the safety element 38 is released by the pivotal movement of the coupling element 24 in such a way that the safety element 38 is moved out of the recess 42 by means of the pretensioned compression spring 44, and is displaced into a path of movement of the pivotable coupling element 24 in such a way that the coupling element 24 is held in the pivoted position (see in that respect FIGS. 2*c* and 2*d*). The spring 30 also loads the coupling element 24 into a non-pivoted position. The safety element 38, which is moved into the path of movement of the coupling element 24, holds the coupling element 24 in the pivoted position in such a way that the coupling portion 40 of the coupling element 24 cannot couple again to the coupling portion 28 of the actuating device 6. Thus, the blade slider 20 is reliably and safely moved back into the safety position (see FIGS. 2*e* and 2*f*).

An abutment 34 in the form of a projection is arranged on the housing 4. The safety element 38 also has a projection 36 of a corresponding configuration to the abutment 34. When the blade slider 20 is moved back from the cutting position (FIGS. 2*b* through 2*d*) into the safety position (FIGS. 2*e* and 2*f*), the projection 36 of the safety element 38 comes to bear against the abutment 34 in such a way that the safety element 38 is pushed again into the recess 42 on the blade slider 20 (see in that respect FIGS. 2*e* and 2*f*). In that case, the spring 44 is compressed again and the safety element 38 is thus again pretensioned. For that purpose, preferably the tension force of the spring 30 is greater than the compression force of the spring 44, so that the safety element 38 is again securely urged into the recess 42. When the safety element 38 is again arranged in the recess 42 (see FIG. 2*f*), the path of movement of the coupling element 24 is cleared again, and the coupling element 24 can pivot back. The return pivotal movement of the coupling element 24 is produced by means of the spring 30. In that case, the blade 10 is also rotated back again in opposite relationship to the x-direction (see FIG. 2*c*). The knife is thus ready for use again, and can be actuated afresh as now the coupling portion 40 of the coupling element 24 is again coupled to the coupling portion 28 of the actuating device 6 (see FIG. 2*a*).

Referring to FIGS. 3*a* and 3*b*, a blade slider 20 is illustrated together with the blade 10 and coupling element 24 independently of the housing 2, 4 of the knife 1. In this embodiment, a blade cover 21 is arranged on the blade slider 20 beside the blade 10, coupling element 24, safety element 38, and compression spring 44. The blade cover 21 serves to even better safeguard the blade 10 against laterally slipping, so that the blade 10 is always reliably arranged with its two through openings 46, 50 on the two projections 48, 52.

FIGS. 3*a* and 3*b* show the blade 10 in a non-rotated condition. Consequently, the coupling element 24 is in a non-pivoted condition. The coupling element 24 is thus arranged in such a way that the safety element 36 is disposed in the recess 42 on the blade slider 20, and the compression spring 44 is compressed. In addition, two abutments 9, 11 are provided on the blade slider 20, which act as a blade rotation limiting means. The blade is pivotably reciprocable about the projection 52 only between the two abutments 9, 11. That prevents excessive rotary movement of the blade.

The cooperation of the blade 10 with the blade slider 20 and the coupling element 24 can be particularly clearly seen from FIGS. 3*a* through 6. While the blade 10 is not rotated in FIGS. 3*a* and 3*b*, and accordingly the coupling element 24 is also not pivoted, the blade 10 is shown in a rotated condition in FIGS. 4*a* and 4*b*, and the coupling element 24 is thus also pivoted.

Looking at FIG. 4*a*, a force F acts on the blade 10, for example by virtue of a cutting reaction force, whereby the blade 10 is rotated about the projection 52 in the x-direction. In that situation, the blade, which previously was substantially in contact with the abutment 9 (see FIG. 3*b*), now rotates until reaching the abutment 11. At the same time, the coupling element 24, which is mounted pivotably at the blade slider 20 and is in engagement with the blade 10 by way of the projection 48, pivots downwardly in relation to FIG. 4*a*. In that case, the coupling element 24 releases the safety element 38 in such a way that it is pushed into the path of pivotal movement of the coupling element 24 by means of the spring 44. For that purpose, the safety element 38 is mounted linearly displaceably and substantially parallel to a longitudinal axis of the knife 1 in the recess 42 on the blade slider 20. The safety element 38 can then be pushed into the recess 42 again by means of the projection 36, so that the coupling element 24 can pivot back again.

The coupling element 24, which is substantially of a bar-shaped configuration (see in particular FIG. 6), is connected to the blade slider 20 with the end towards the blade 10 by means of a pivotal mounting 25. The coupling element 24 is arranged on the side of the blade slider 20 that is opposite to the blade 10. The pivotal mounting 25 is arranged approximately in an opposite relationship to the cylindrical projection 52 on a rear side of the blade slider 20. In that arrangement, the cylindrical projection 52 is formed integrally on the blade slider 20. In addition, the blade slider 20 has a substantially oval slot 49 in a central region that is spaced in relation to the projection 52. The cylindrical projection 48 of the coupling element 24 extends through that slot 49 from the rear side of the blade slider 20, so that the blade 10 can be in engagement with the coupling element 24 by means of the through opening 46 (see FIGS. 3*b* and 4*a*). In that case, the slot 49 is of such dimensions that the coupling element 24 can unimpededly pivot to and fro. The coupling element 24 is accordingly pivoted by means of the blade 10 in the same direction as that in which the blade 10 rotates. Alternatively, the two projections 48, 52 can also be suitably laterally interchanged so that the coupling element 24 pivots in opposite relationship to the direction of rotation of the blade 10.

FIGS. 7*a* through 10*d* show a knife 1 in accordance with a second embodiment, or parts of the knife 1 in accordance with the second embodiment. The same and similar parts are denoted by the same references. In that respect, attention is directed in its entirety to the foregoing description and reference is made thereto. As the knife 1 of this second embodiment has a large number of points in common with the knife in accordance with the first embodiment (FIGS. 1*a* through 6), the differences are primarily described hereinafter.

The knife 1 in the second embodiment has a two-part housing 2, 4, an actuating device 6, and an opening 8 arranged on a front portion of the housing 2, 4. In contrast to the first embodiment, the actuating device 6 in the second embodiment is in the form of a so-called pincer grip. Accordingly, the actuating device has a handle grip 60 connected to the housing 2, 4 pivotably by means of a pivot mounting 62. At the end of the handle grip 60 that is remote from the pivot mounting 62, there is a fin 64 projecting into the housing 2, 4. By actuation of that handle grip 60, for example by pressing thereon with the fingers, the blade 10 is moved from a safety position (in FIG. 7*a*) into a cutting position (in FIG. 7*b*).

Such a pincer grip uses as its drive the mode of operation of an inclined plane, as can be seen in particular from FIGS. 8*a* and 8*b*. In those Figures (FIGS. 8*a* and 8*b*), the knife 1 is shown with an opened housing 2, 4. That is to say, the one housing half 2 is removed. A blade slider 20 is mounted displaceably on the housing 4. In this embodiment, the blade slider 20 is movable on a curved path of movement as the knife 1 overall is curved. Such a curved knife 1 is of a more ergonomical shape, and therefore lies better in the hand of the user. That also enhances the safety aspect. A blade 10 is mounted pivotably about a projection 52 on the blade slider 20. A coupling element 24 is also mounted pivotably on the blade slider 20. The coupling element 24 is arranged on the side of the blade slider that is opposite to the blade 10 (see in that respect FIGS. 10*b* and 10*d*). The coupling element 24 cooperates with the actuating device 6 and couples therewith to move the blade slider 20 from the safety position (FIG. 8*a*) into the cutting position (FIG. 8*b*). For that purpose, the actuating device 6 has an actuating element 70 which is also arranged displaceably on the housing 4, and more specifically on a side of the blade slider 20 that is remote from the blade 10. At the rear end, the actuating element 70 has an engagement portion 72 on which an inclined plane 74 is provided. The inclined plane 74 cooperates with the inclined plane 66 of the fin 64, which is arranged on the handle grip 60. By pressing on the handle grip 60, the fin 64 is moved into the housing 2, 4, whereby the inclined plane 74 of the actuating element 70 slides against the inclined plane 66 of the fin 64 and thus, coupled with the coupling element 24, moves the blade slider 20 from the safety position (FIG. 8*a*) into the cutting position (FIG. 8*b*).

A safety element 38 is also arranged slidably on the blade slider 20. In this embodiment (FIGS. 7*a* through 10*d*), the safety element 38 is of a stirrup-like configuration, and is pretensioned by means of a spring 44, which in this embodiment is in the form of a tension spring. The spring 44 is tensioned between a hook 43 of the safety element 38, and a portion 45 of the blade slider 20. A further spring 30, which forms the return element 30, is tensioned between the coupling element 24 and a hook 32 on the housing to restore the blade slider to the safety position. In addition, a spring 80 is tensioned between a hook 78 of the actuating element 70 and a hook 82 on the housing 4 to pull the actuating element 70 into the safety position, and to move the fin 64 out of the housing 2, 4 and thus to pivot the handle grip 60 back into a non-pivoted position (springs 30, 44 and 80 are shown only in FIG. 8*a*).

FIGS. 8*a* through 8*g* also show the sequence of movements involved in actuation of the actuating device 6 from the safety position into the cutting position because of the blade slider 20. The sequence of movements includes the rotation of the blade 10, the pivotal movement of the coupling element 24, and the return movement of the blade slider 20.

Figure 8G:
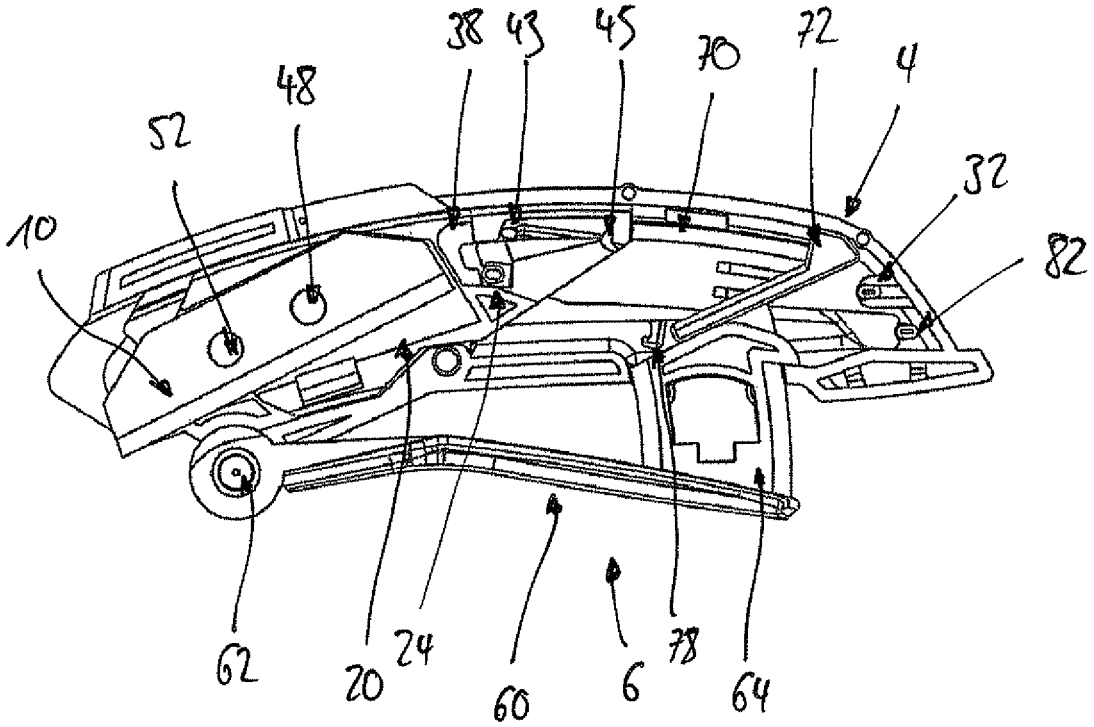
FIG. 8*g* shows the knife of FIG. 8*f* with a blade which has been rotated back.
Figure 9C:
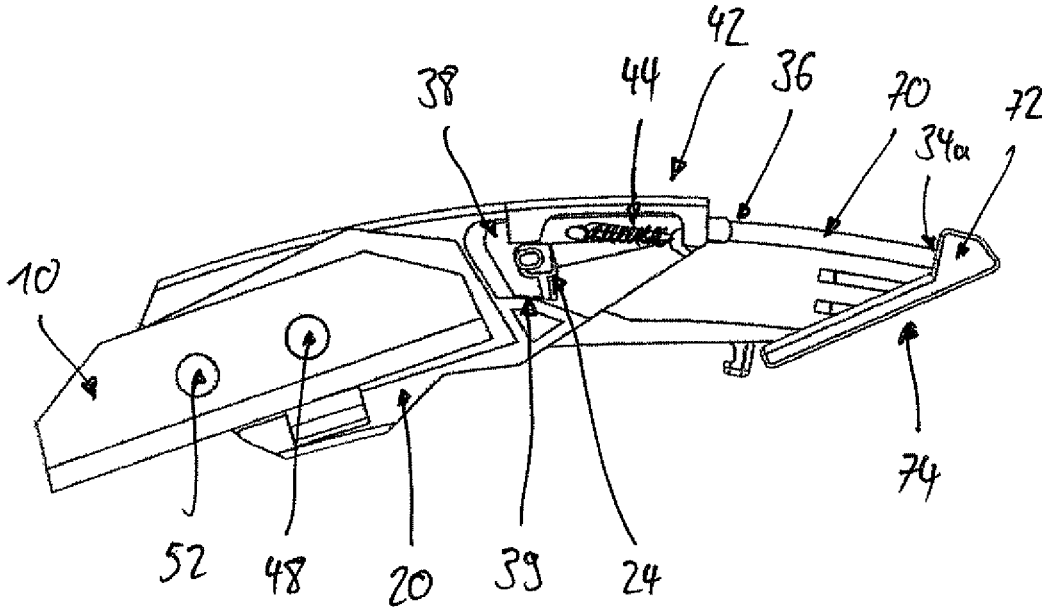
FIG. 9*c* shows the blade slider with a blade of FIG. 9*b* with displaced safety element.

The knife 1 is in a condition of being ready for operation in FIG. 8*a*. The handle grip 60 is not pivoted, and therefore the fin 64 is not pushed into the housing 2, 4. The blade slider 20, together with blade 10, is in the safety position. The actuating element 70 is also in the safety position. The blade 10 is not rotated and bears substantially against the abutment 9. Accordingly, the coupling element 24 is also in a non-pivoted condition. As can be seen in particular from FIG. 10*b*, the coupling element 24 is arranged on a side of the blade slider 20 opposite to the blade 10. In the non-pivoted condition (shown in FIGS. 8*a*, 8*b*, 8*g*, 9*a*, 10*a* and 10*b*), the coupling element 24 is coupled to the actuating device 6 by the coupling portion 40 (FIG. 10*b*) being coupled to the coupling portion 28 of the actuating element 70. Both the coupling portion 40 of the coupling element 24 and the coupling portion 28 of the actuating element 70 are in the form of contact surfaces.

When the actuating device 6 is actuated, that is to say, the handle grip 60 is pivoted about the pivot mounting 62 and the fin 64 is introduced into the housing 2, 4, the inclined plane 66 of the fin 64 presses against the inclined plane 74 of the actuating element 70, and thus moves the actuating element 70 from the safety position (FIG. 8*a*) into the cutting position (FIG. 8*b*). In that case, the actuating element 70 is coupled to the coupling element 24 (FIG. 10*b*), whereby the blade slider 20 is also moved from the safety position (FIG. 8*a*) into the cutting position (FIG. 8*b*).

When performing a cutting operation by means of the knife 1, a force F (FIGS. 8*c* and 9*b*) then acts on the blade 10 and rotates the blade 10 about the projection 52 in the x-direction. The blade 10 rotates until reaching the abutment 11 (FIGS. 8*a*, 9*a* and 9*b*). In that case, the coupling element 24 is in engagement by means of the projection 48, which extends through the through opening 46 (FIGS. 8*c* and 9*a*) in the blade, so that the coupling element 24 is pivoted by the rotary movement of the blade 10 (see in particular also FIGS. 10*a* through 10*d*). For that purpose, the coupling element 24 is mounted to the blade slider 20 pivotably by means of the pivotal mounting 25 (FIGS. 10*a* through 10*d*). In this embodiment (FIGS. 7*a* through 10*d*), the pivotal mounting 25 is arranged between the engagement portion 40 and the projection 48. Therefore, the coupling element 24 pivots in the opposite direction to the rotary movement of the blade 10. The coupling element 24 is substantially bar-shaped (FIGS. 10*b* and 10*d*), and thus acts as a lever. In the pivotal movement of the coupling element (non-pivoted condition: FIG. 10*b*; pivoted condition: FIG. 10*d*), the coupling element is uncoupled from the actuating element 70 by the coupling portion 40 coming out of engagement from the coupling portion 28. Accordingly, the coupling element 24 pivots upwardly as best shown in FIGS. 8*b*, 8*c* and 9*a*, 9*b*.

The safety element 38 is also mounted slidably in a recess 42 (FIGS. 9*a*, 9*b* and 9*c*) on the blade slider 20. In a non-pivoted condition of the coupling element 24 (see in particular FIGS. 9*a* and 10*a*), the coupling element 24 blocks the path of movement of the safety element 38 by the portion 39 of the safety element 38 pressing against a portion of the coupling element 24. As already described hereinbefore, the safety element 38 is pretensioned by means of the spring 44, insofar as the spring 44 is tensioned between a hook 43 on the safety element 38 and a portion 45 of the blade slider 20. When the coupling element 24 is pivoted (see in particular FIG. 9*b*), the portion 39 of the safety element 38 comes free, so that the safety element 38 can be displaced by means of the spring 44. In that case, the portion 39 of the safety element 38 moves into the path of movement of the coupling element 24 (see in particular FIGS. 9*b* and 9*c*) in such a way that the coupling element 24 cannot pivot back again. The blade slider 20 is reliably returned by means of the spring 30 (FIG. 8*a*) from the cutting position into the safety position, and the coupling element 24 is secured by means of the safety element 38 in such a way that it cannot come into engagement with the actuating element 70 again.

When the actuating device 6 is still actuated so that the handle grip 60 is still pivoted, the actuating element 70 is still in the cutting position. Consequently, the blade slider 20 moves in the return movement relative to the actuating element 70 (not shown in the Figures). In the return movement of the blade slider, the safety element 38 is also displaced. At a side opposite to the blade 10, the safety element 38 has a projection 36 which comes out of the recess 42 in the displacement of the safety element 38. In the return movement, or when reaching the safety position, the projection 36 comes into contact with an abutment 34 on the housing 4 (FIGS. 8*d*, 8*e* and 8*f*) so that the safety element 38 is pushed into the recess 42 again, and the coupling element 24 can pivot back again so that the knife 1 is again ready for operation. Alternatively or additionally, the projection 36 comes into contact with an abutment 34*a* on the engagement portion 72 of the actuating element 70, and is thus pushed into the recess 42 again.

The invention claimed is:

1. A knife comprising:

a housing;

a blade slider that is mounted to the housing and is reciprocable by an actuating device between a safety position and a cutting position;

a return element for applying a return force to the blade slider in the direction of the safety position;

a blade arranged on the blade slider, wherein the blade is rotatably mounted to the blade slider; and a coupling element connected to one of the blade slider or the actuating device, the coupling element coupling the blade slider and the actuating device together upon a movement of the blade slider from the safety position into the cutting position, and the coupling element uncoupling the blade slider and the actuating device in the cutting position in response to a rotary movement of the blade relative to the blade slider so that the blade slider is restored to the safety position by the return element.

2. The knife of claim 1, wherein the blade slider includes an abutment for limiting a rotary movement of the blade relative to the blade slider.

3. The knife of claim 1, wherein the blade slider includes a side facing the blade and a side opposite to the blade, and the coupling element is arranged on the side opposite to the blade.

4. The knife of claim 1, wherein the coupling element is mounted pivotably to the blade slider and is engaged with the blade so that the coupling element is pivotable by the rotary movement of the blade.

5. The knife of claim 1, wherein the coupling element is a substantially bar-shaped lever having a first end remote from the blade, the first end including a coupling portion for coupling to the actuating device.

6. The knife of claim 5, wherein the actuating device includes a coupling portion defined by a projection, and the coupling portion of the coupling element is defined by an abutment surface, the projection cooperating with the abutment surface to move the blade slider from the safety position into the cutting position in response to actuation of the actuating device.

7. The knife of claim 1, wherein the return element is a tension spring including a first end coupled to the coupling element and a second end coupled to the housing.

8. The knife of claim 1, further comprising:

a safety element for holding the coupling element in a pivoted position on at least a portion of the path of movement of the blade slider between the cutting and the safety positions.

9. The knife of claim 8, wherein the safety element is mounted movably to the blade slider.

10. The knife of claim 9, wherein the safety element is mounted to the blade slider so that in response to uncoupling of the coupling element from the actuating device, the safety element moves into the path of movement of the coupling element in such a way that the pivoted position of the coupling element is maintained on at least a portion of the path of movement of the blade slider between the cutting position and the safety position.

11. The knife of claim 8, further comprising:

a tensioning element for pretensioning the safety element and that urges the safety element into the path of movement of the coupling element in response to the safety element being released by the coupling element uncoupling the blade slider and the actuating device.

12. The knife of claim 8, further comprising:

a device for moving the safety element out of the path of movement of the coupling element while the blade slider is in the safety position so that the coupling element can couple to the actuating device.

13. The knife of claim 12, wherein the device for moving the safety element includes an abutment.

14. The knife of claim 12, wherein the device for moving the safety element includes a projection.

15. A knife comprising:

a housing;

a blade slider that is mounted to the housing and is reciprocable by an actuating device between a safety position and a cutting position;

a return element for applying a return force to the blade slider in the direction of the safety position;

a blade arranged on the blade slider, wherein the blade is rotatably mounted to the blade slider; and a coupling element connected to one of the blade slider or the actuating device, the coupling element coupling the blade slider and the actuating device together upon a movement of the blade slider from the safety position into the cutting position, and the coupling element uncoupling the blade slider and the actuating device in the cutting position in response to a rotary movement of the blade relative to the blade slider so that the blade slider is restored to the safety position by the return element, wherein the blade includes first and second through openings, the blade slider includes a projection that passes through the first through opening, and the coupling element includes a projection that passes through the second through opening.

* * * * *